US005465488A

United States Patent [19]

Yaw et al.

[11] Patent Number: 5,465,488

[45] Date of Patent: Nov. 14, 1995

[54] FOLDING RAZOR

[76] Inventors: Ke G. Yaw; Hsu S. Wei, both of P.O. Box 82-144, Taipei, Taiwan

[21] Appl. No.: 362,970

[22] Filed: Dec. 23, 1994

[51] Int. Cl.[6] ..... B26B 21/00; B26B 21/14

[52] U.S. Cl. ..... 30/41; 30/47; 30/86

[58] Field of Search ..... 30/41, 47, 85, 30/86, 87; 206/228; 132/289; D28/46–48

[56] References Cited

U.S. PATENT DOCUMENTS 5,009,004 4/1991 Yen ..... 30/47

*Primary Examiner*—Douglas D. Watts

*Attorney, Agent, or Firm*—Alfred Lei

[57] ABSTRACT

A razor including an inner tubular member formed with two opposite longitudinal slots of different length, a blade assembly fitted into the inner tubular member and including a first mounting element and a second mounting element engaged with the first mounting element, an intermediate tubular member enclosing the inner tubular member, an outer tubular member enclosing the intermediate tubular member and having at an inner bottom a protruded portion formed with a plurality of tenons adapted to engage the mortises of the inner tubular member, and a cap having an opening at a center and engageable with a top end of the intermediate tubular member, whereby the razor will be completely kept from dirt when not in use.

3 Claims, 6 Drawing Sheets

FOLDING RAZOR

BACKGROUND OF THE INVENTION

It has been found that the conventional razor is simply composed of a T-shaped member and a blade mounted on the top end thereof. Further, in order to prevent blade from accidental touching, a plastic cap is used to fit on the blade. Nevertheless, such a razor requires special care thereby making it inconvenient to carry. Hence, a foldable razor assembly disclosed in U.S. Pat. No. 5,009,004 has been developed to eliminate this drawback. As shown in FIGS. 8, 9 and 10, the foldable razor assembly includes an outer cylinder 50 formed with a spiral slot 51 at its internal surface, an inner cylinder 60 provided with a round edge 61 at the upper end, a notch 62, two vertical slots 63 with different height, a circular slot 64 at the lower end, a shaft means 70 consisting a first mounting element 71 and a second mounting element 72 which are each formed with a pimple 73, and a cap 65 having hooks 66 adapted engage the circular slot 64 of the inner cylinder.

However, the top of the outer cylinder 50 is open at one end even if the razor is not in use hence making it impossible to keep clean and sanitary.

Therefore, it is an object of the present invention to provide an improvement in the structure of a foldable razor which can obviate and mitigate the above-mentioned drawbacks.

SUMMARY OF THE INVENTION

This invention relates to an improvement in the structure of a foldable razor.

It is the primary object of the present invention to provide a razor which can be completely sealed when not in use.

It is another object of the present invention to provide a razor which is free from dirt which might cause disease.

It is still another object of the present invention to provide a razor which is safe in use.

It is still another object of the present invention to provide a razor in which a shaving cream can be stored within the bottom of the handle.

It is a further object of the present invention to provide a razor which is convenient to use and fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
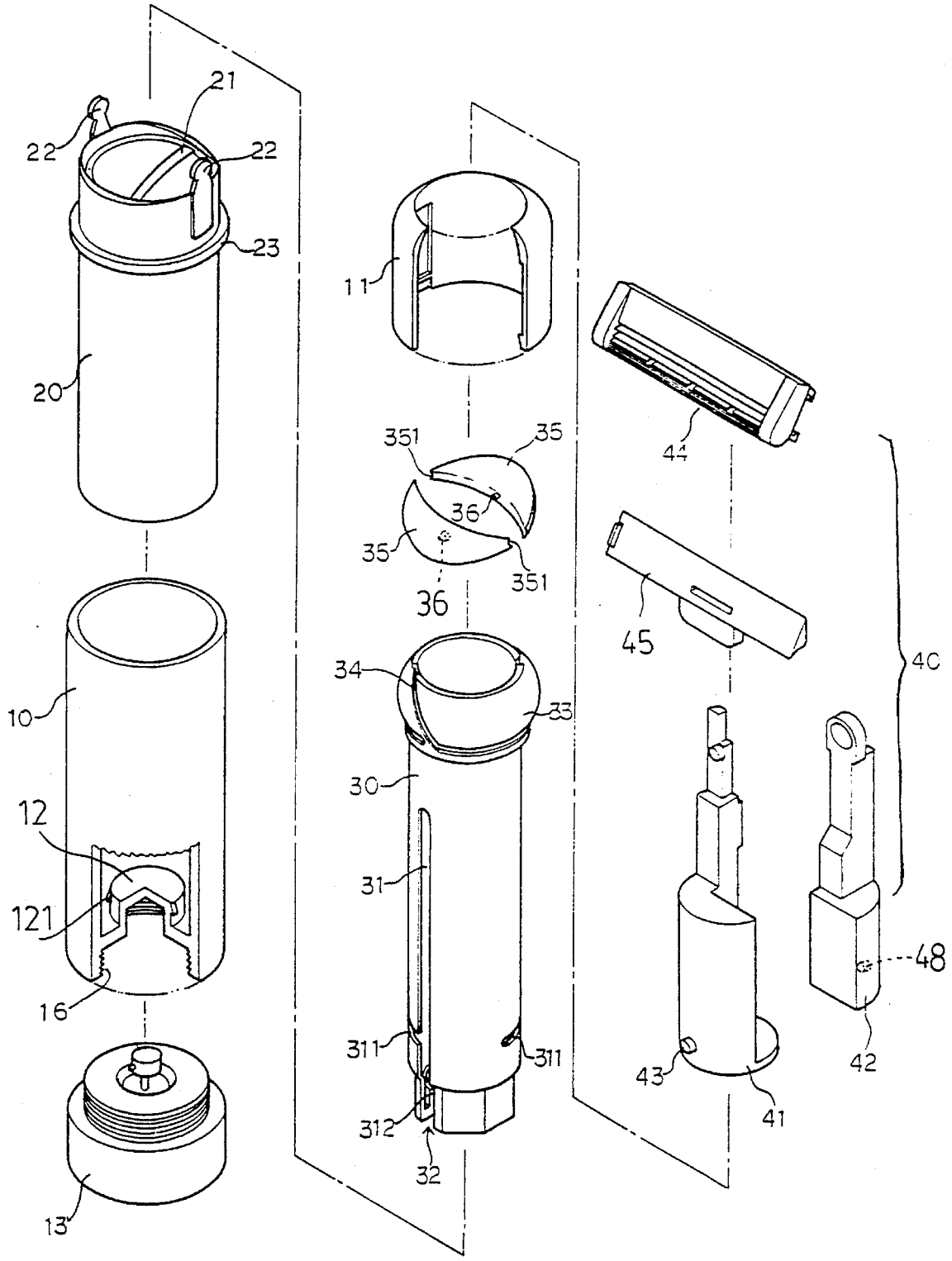
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
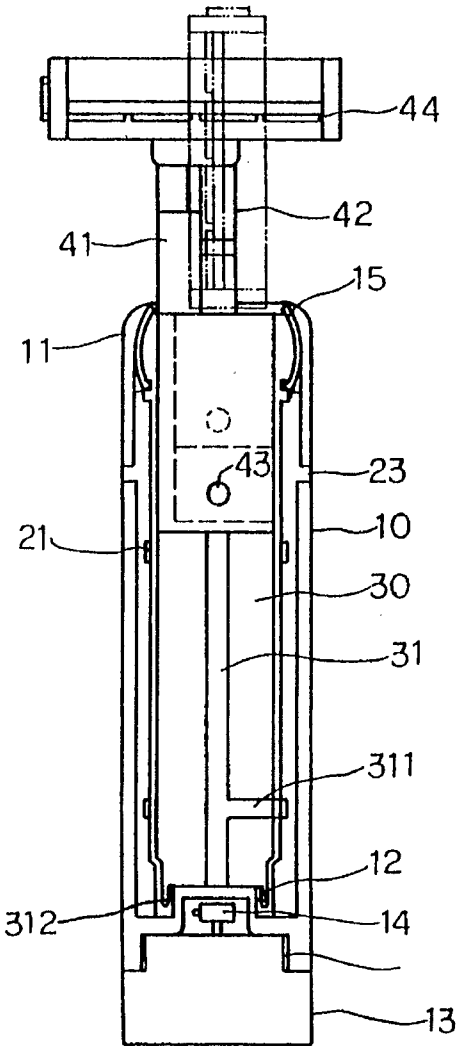
Figure 5:
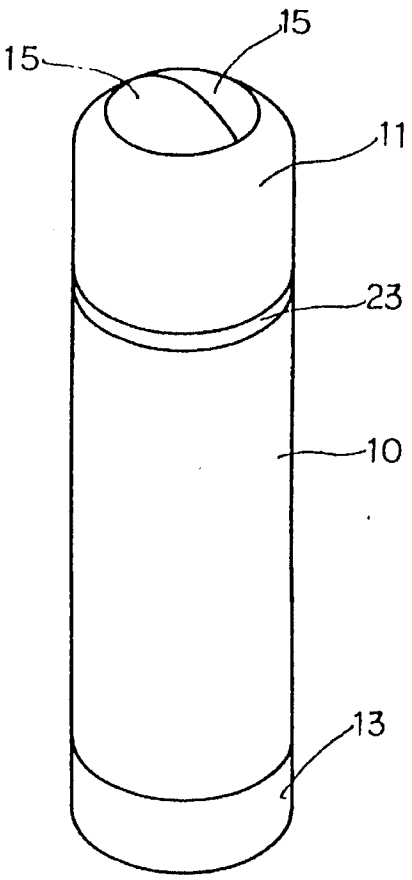
FIG. 5 is perspective view of the present invention, with the curved covers at a closed position.
Figure 4:
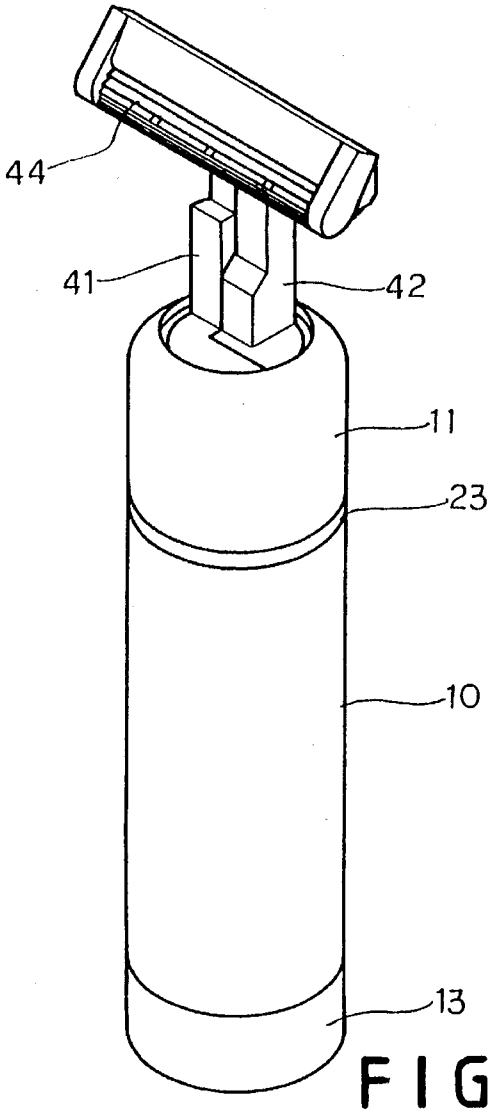
FIG. 4 is a perspective view of the present invention, with the blade assembly rotated to a horizontal extended position.
Figure 7:
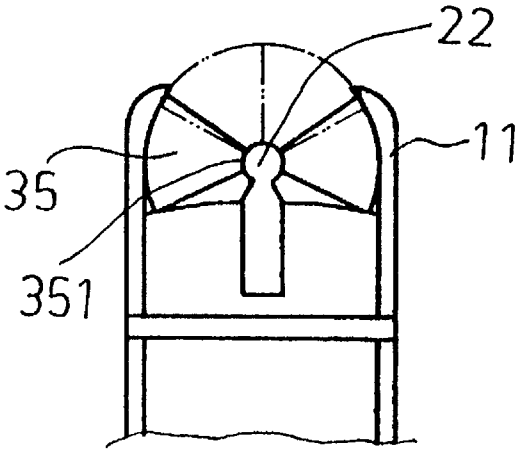
FIG. 7 shows the working principle of the blade assembly.
Figure 6:
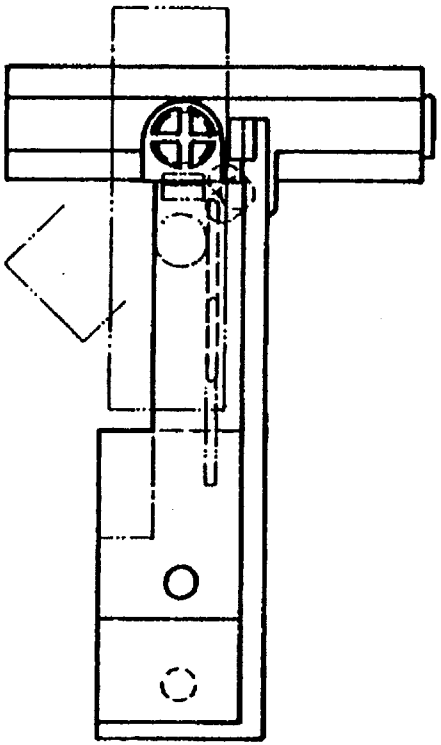
FIG. 6 shows the engagement between the curved covers and the intermediate tubular member.

With reference to the drawings and in particular to FIGS. 1 and 2 thereof, the razor according to the present invention mainly comprises an outer tubular member 10, an intermediate tubular member 20, an inner tubular member 30, a cap 11, and a blade assembly 40.

Figure 8:
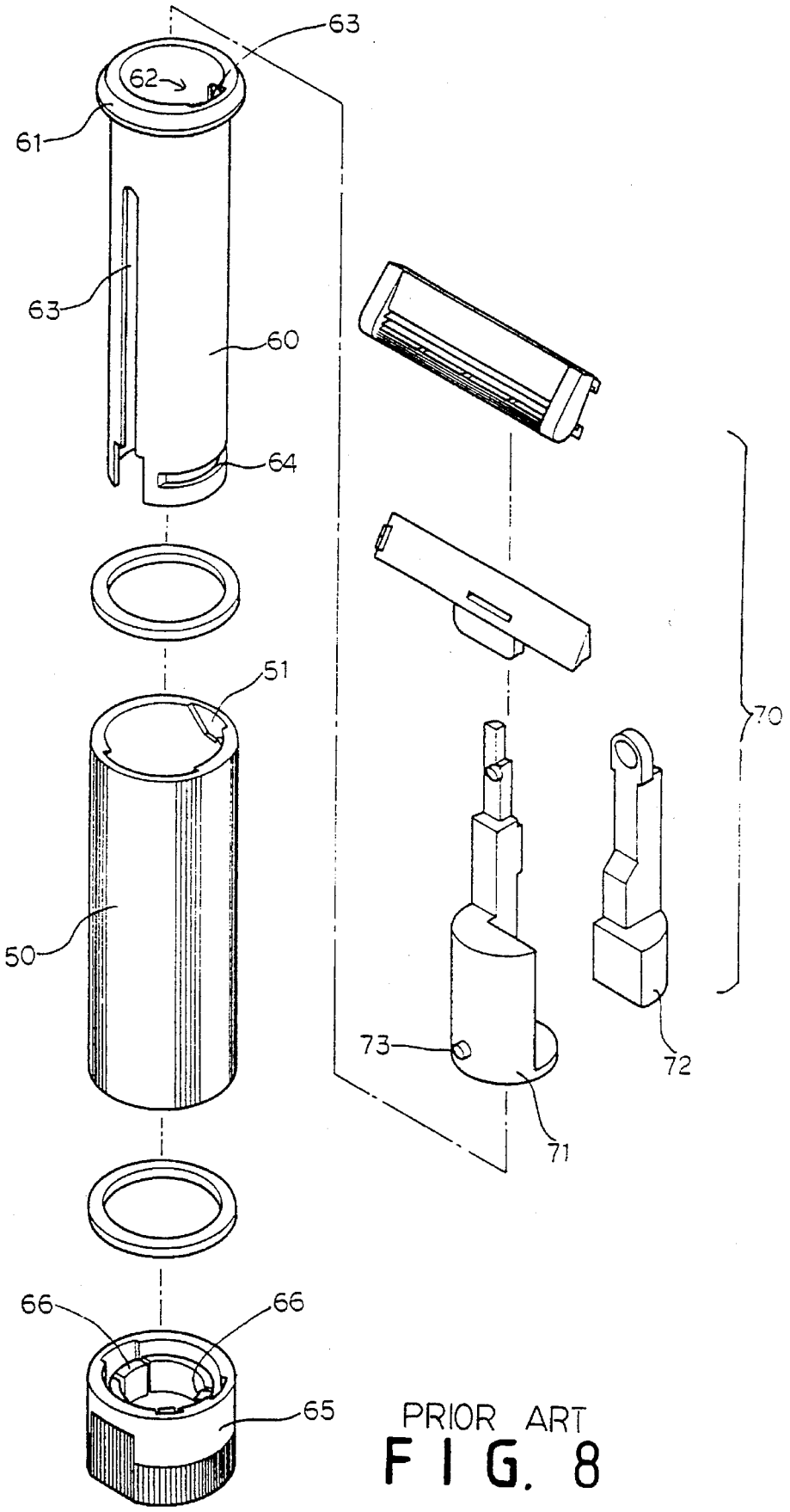
PRIOR ART FIG. 8
FIG. 8 is a perspective view of a prior art foldable razor.
Figure 9:
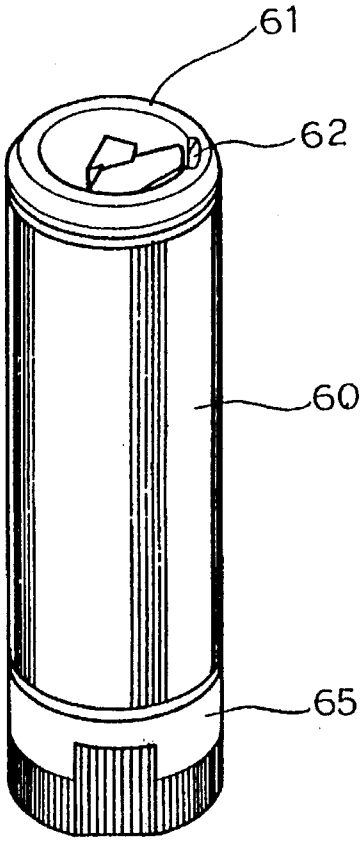
PRIOR ART FIG. 9
FIG. 9 is a perspective view of the prior art foldable razor.
Figure 10:
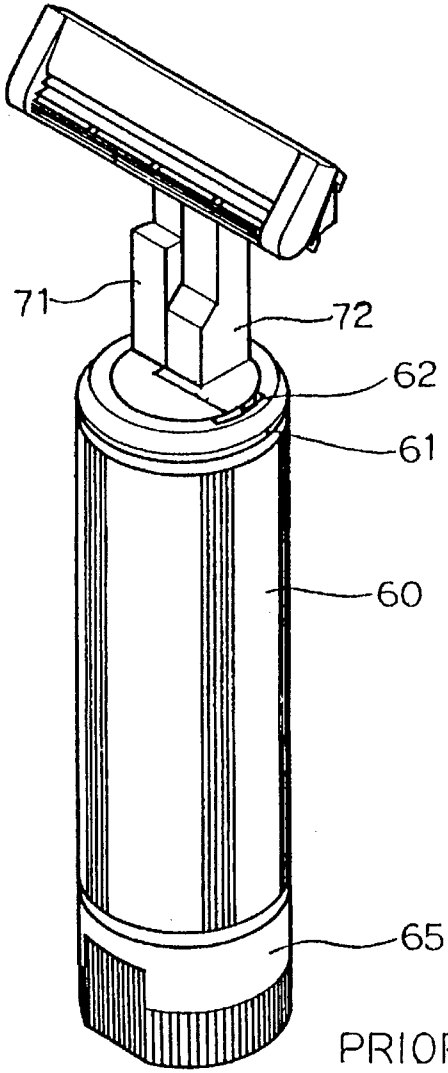
PRIOR ART FIG. 10
FIG. 10 is a perspective view of the prior art foldable art with the blade assembly rotated to a horizontal extended position.

The blade assembly 40 includes a first mounting element 41, a second mounting element 42, a support 45, and a blade 44. The first mounting element 41 and the second mounting element 42 are respectively provided with protuberances 43 and 48 at the lower portion. The blade assembly 40 has the same structure as the blade assembly 70 shown in U.S. Pat. No. 5,009,004 (see FIG. 8). The blade assembly 40 is not considered as a part of the present invention and has no need to be described here in detail.

The inner tubular member 30 is formed with two opposite longitudinal slots 31 which are of different length. The blade assembly 40 is disposed within the inner tubular member 30, with the protuberance 43 of the first mounting element 41 received in the short slot 31 and the protuberance 48 received in the long slot 31. Both slots 31 are formed with an outlet 32 at the lower end and a horizontal slot 311 along the circumference of the inner tubular member 30. Further, the lower end of the inner tubular member 30 is formed with an annular flange 312 having a plurality of mortises (not shown). The upper end of the inner tubular member 30 has a spherical portion 33 on which are formed a pair of grooves 34. Each of the grooves 34 first extends slantwise from the upper edge to the lower edge and then extends horizontally along the surface of the lower edge. The groove 34 is designed so that the length of its horizontal portion is just equal to the rotating angle of the stroke of the slot 31 and its slant portion just corresponds to the stroke of the horizontal slot 311. A pair of curved covers 35, which are in the shape of a quarter of a sphere and have a projection 36, are engaged with the spherical portion 33 of the inner tubular member 30 with the projection 36 fitted in the corresponding groove 34. The curved cover 35 is further formed with a notch 351 at both ends thereof.

The inner tubular member 30 is fitted into the intermediate tubular member 20 the inner surface of which is provided with a spiral groove 21. The protuberance 43 of the first mounting element 41 of the blade assembly 40 is received in the spiral groove 21 of the intermediate tubular member 20 so that when the intermediate tubular member 20 is rotated, the protuberance 43 of the first mounting element 41 move along the spiral groove 21 of the intermediate tubular member 20 thereby enabling the support 45 to extend out of the inner tubular member 30 and rotate to a horizontal position. The upper end of the intermediate tubular member 20 is provided with a pair of lugs 22 having a circular top end adapted to engage the notch 351 of the curved cover 35. The intermediate tubular member 20 is formed with a flange 23 close to its upper end. A cap 11 having an opening at the center is fitted on the upper portion of the intermediate tubular member 20 with its lower edge contacting the top of the flange 23 of the intermediate tubular member 20.

The intermediate tubular member 20 is inserted in the outer tubular member 10 with its upper edge contacting the bottom of the flange 23 of the intermediate tubular member 20. Further, the inner bottom of the outer tubular member 10 is formed with a protruded portion 12 having a plurality of tenons 121 adapted to engage the mortises (not shown) of the annular flange 312 of the inner tubular member 30. The outer bottom of the outer tubular member 10 has a threaded recess 16 engageable with a shaving cream container 13.

Figure 3:
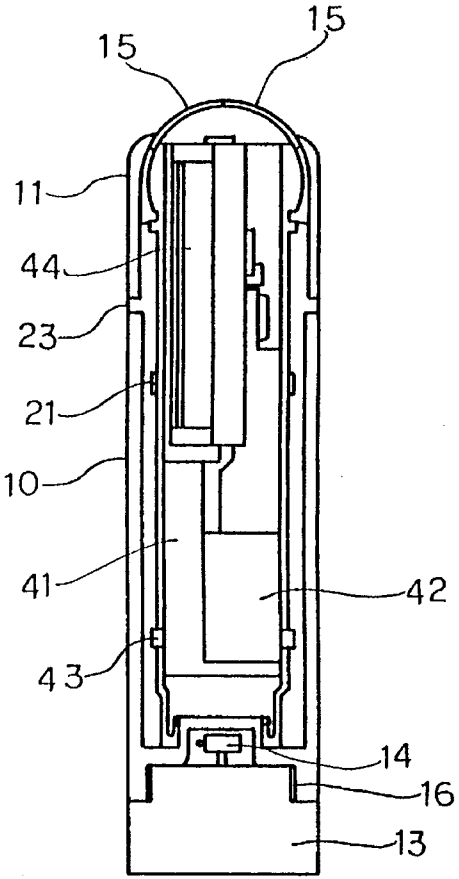
FIGS. 2 and 3 show the relative positions of the component part the present invention.

When in use, simply rotate the outer tubular member 10 to first open the curved covers 35 and then push the blade assembly 40 to a horizontal extended position (see FIGS. 2 and 3). When not in use, it is only necessary to turn outer tubular member 10 to retract the blade assembly 40 into the inner tubular member 30. In the meantime, the curved covers 35 is turned closed thereby keeping the dirt from the interior of the present invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

We claim:

1. A razor comprising:

an inner tubular member formed with two opposite longitudinal slots of different length, each of said slots being formed with an outlet at a lower end, a horizontal slot along a circumference of said inner tubular member, and an annular flange with a plurality of mortises, said inner tubular member being formed at an upper end with a spherical portion having a pair of grooves extending slantwise from an upper edge to a lower edge and then horizontally along a surface of the lower edge;

a blade assembly fitted into said inner tubular member and including a first mounting element and a second mounting element engaged with the first mounting element, said first mounting element being formed with a protuberance at a lower end;

an intermediate tubular member enclosing said inner tubular member, said intermediate tubular member being formed at an inner surface with a spiral groove adapted to receive a protuberance of said first mounting element and at an upper the end with two lugs;

an outer tubular member enclosing said intermediate tubular member and having at an inner bottom a protruded portion formed with a plurality of tenons adapted to engage the mortises of said inner tubular member; and a cap having an opening at a center and engageable with a top end of said intermediate tubular member.

2. The razor as claimed in claim 1, wherein said lugs are formed with a circular portion at a top end.

3. The razor as claimed in claim 1, further comprising a shaving cream container engaged with a bottom end of said outer tubular member.

* * * * *